US006150612A

United States Patent [19]

Grandy et al.

[11] Patent Number: 6,150,612

[45] Date of Patent: Nov. 21, 2000

[54] HIGH PERFORMANCE DATA CABLE

[75] Inventors: Mark E. Grandy, Port Huron; Edwin D. Laing, Marysville, both of Mich.; Janet M. Rosenbaum, Sidney, Nebr.; James J. Pelster, Sidney, Nebr.; Rune Totland, Sidney, Nebr.; Jim L. Dickman, II, Sidney, Nebr.; Mark W. White, Sidney, Nebr.; David J. Wiekhorst, Potter, Nebr.; Timothy N. Berelsman, Delphos, Ohio

[73] Assignee: Prestolite Wire Corporation, Southfield, Mich.

[21] Appl. No.: 09/062,059

[22] Filed: Apr. 17, 1998

[51] Int. Cl.[7] ..... H01B 11/02

[52] U.S. Cl. ..... 174/113 C

[58] Field of Search ..... 174/113 C, 113 R, 174/131 A, 121 A; 385/105, 110, 112

[56] References Cited

U.S. PATENT DOCUMENTS

| | | | |
|---|---|---|---|
| 483,285 | 9/1892 | Guilleaume | 174/113 C |
| 4,408,443 | 10/1983 | Brown et al. . | |
| 4,600,268 | 7/1986 | Spicer | 174/113 C X |
| 4,807,962 | 2/1989 | Arroyo et al. | 385/110 |
| 5,010,210 | 4/1991 | Sidi et al. . | |
| 5,162,609 | 11/1992 | Adriaenssens et al. | 174/113 R X |
| 5,177,809 | 1/1993 | Zeidler | 385/105 |
| 5,289,556 | 2/1994 | Rawlyk et al. | 385/112 X |
| 5,424,491 | 6/1995 | Walling et al. . | |
| 5,563,377 | 10/1996 | Arpin et al. | 174/121 A |
| 5,574,250 | 11/1996 | Hardie et al. | 174/36 |
| 5,689,090 | 11/1997 | Bleich et al. | 174/121 A |
| 5,789,711 | 8/1998 | Gaeris et al. | 174/113 C |
| 5,841,072 | 11/1998 | Gagnon | 174/121 A X |
| 5,841,073 | 11/1998 | Randa et al. | 174/113 R |
| 5,931,474 | 8/1999 | Chang et al. | 277/316 |
| 5,969,295 | 10/1999 | Boucino et al. | 174/113 C |

FOREIGN PATENT DOCUMENTS

| | | |
|---|---|---|
| 0 763 831 | 3/1997 | European Pat. Off. . |
| WO 96/41908 | 12/1996 | WIPO . |

OTHER PUBLICATIONS

Patent Abstracts of Japanese Patent No. 09 139121 dated May 27, 1997 for Communication Cable.

Written Opinion for International Application No. PCT/US99/08365 Apr. 2000.

"Engineering Design Guide" C&M Corporation, pp. 10–11, 1992.

*Primary Examiner*—Kristine Kincaid
*Assistant Examiner*—Chau N. Nguyen
*Attorney, Agent, or Firm*—Rader, Fishman & Grauer PLLC

[57] ABSTRACT

High performance data cables are provided that allows for future growth in networking speeds. The high performance data cables achieve this result while satisfying the dimensional requirements set by the EIA/TIA 568-A standards as well as fire performance safety requirements of the National Fire Protection Association (NFPA). High performance data cables of this invention achieve the above by controlling parameters that influence impedance performance, near-end crosstalk performance and attenuation. A separating filler material is used to maximize the pair-to-pair distance while maintaining an overall maximum outside diameter of 0.250". This construction benefits crosstalk performance, as both electrical and magnetic field intensities are inversely related to distance and dielectric constant (crosstalk is made up of capacitative and inductive coupling, with inductive coupling becoming significant at frequencies above 50 MHz). Balancing between parameters that influence impedance, near-end crosstalk and attenuation performance by choice of materials and physical dimensions of the filler material, insulation material, jacket material and conductor, the overall performance of the data cable of this invention is achieved. A standard for the high performance data cables of this invention is also disclosed.

26 Claims, 2 Drawing Sheets

HIGH PERFORMANCE DATA CABLE

TECHNICAL FIELD OF THE INVENTION

This invention relates to data cables, and more particularly to providing high performance data cables that are capable of performing at high transmission frequencies while meeting or exceeding the standards set forth by EIA/TIA 568-A standards for transmission frequencies up to 100 MHz. The data cables according to this invention achieve high transmission frequencies while maintaining data integrity.

BACKGROUND OF THE INVENTION

With the widespread use of personal computers and the need to network them together, the ensuing volume of data traffic has accentuated the need for computer networks to operate at higher speeds. These speeds range from 10 Mbps (mega bits per second) to beyond 1000 Mbps. In light of the fact that the volume of data traffic is progressively increasing, network speed requirements well beyond 1000 Mbps may soon be required.

Standard high frequency data cable configurations typically utilize unshielded twisted pair (UTP) wiring in a four twisted pair configuration. These data cables are evaluated using several performance parameters. Three parameters of importance in this evaluation are impedance, attenuation and crosstalk. The Electronic Industries Association/Telecommunications Industry Association (EIA/TIA) provides standard specifications regarding the above-mentioned parameters in relation to attained transmission frequencies for data cable performance. These specifications are adopted throughout The United States of America as the standard for data cable performance. Moreover, in light of the domestic success of these cable standards, several foreign countries have adopted these or other similar standards.

As discussed above, three parameters of importance in evaluating data cable performance are impedance, attenuation and crosstalk. Impedance, in turn, is further categorized as characteristic or average impedance and input impedance (actual measured response). The characteristic or average impedance of twisted pair cables is primarily influenced by the dielectric constant of the material surrounding the conductor, the outside diameter of the insulated conductor and the outside diameter of the conductor itself. Theoretically, characteristic impedance is inversely proportional to the outside diameter of the conductor and the square root of the dielectric constant, and directly proportional to the distance between the centers of the conductors.

It has been found that the number of twists per foot in a twisted pair cable also has an impact on the impedance performance. The tighter the twist (or the more twists per foot), the lower the impedance performance, unless the effect is compensated by increasing the outside diameter of the insulated conductor. Impact on characteristic impedance due to pair twisting is believed to be caused by increased lay pitch influencing capacitive and inductive coupling between the conductors of a pair.

Input or actual measured impedance of a cable is largely influenced by conductor centering within its insulation, as well as conductor ovalness and insulated conductor ovalness. Secondary parameters affecting input impedance performance include insulation purity, pair-to-pair relationships, pair lay lengths (distance between successive twists), overall cable lay length and jacket tightness.

Conductor centering is measured, and expressed as a percentage, by dividing the minimum insulation wall thickness by the maximum wall thickness. This expression of centering assumes perfect ovalness of the copper and insulated wire. Ovality of the copper used in conductors is controlled by establishing stringent requirements and routine insulation tip and die inspection/maintenance schedules.

Another technique for controlling input impedance is to simultaneously extrude and bond the two insulated conductors of a pair in a single process. This approach, exemplified in U.S. Pat. No. 5,606,151, is aimed at assuring constant and consistent conductor to conductor spacing throughout the finished wire.

A disadvantage of using such a technique is that bonded pairs must be handled more carefully in further processing. Furthermore, bonded pairs limit the tightness of pair lays that can be utilized as well as overall production speeds at pairing. Another aspect of bonded pairs that is highly undesirable is the increased labor involved to install and terminate this product in a premises-cabling system. In order to install and terminate bonded pairs on data grade connecting hardware, the wires must first be separated. This step adds labor to installation and introduces a potential to performance degradation from human error if the wires are not evenly separated.

Yet another technique for controlling input impedance involves the use of planetary cabling or back twist pairing equipment utilizing back twist neutralizers. This approach actually creates a periodic inconsistency equal in length to the pairing lay length. Since most lay lengths in data grade (EIA/TIA 568-A Category 5) cables are less than 1.0", the influence of periodic inconsistencies on impedance performance will not be present at frequencies below 2 Gigahertz.

A disadvantage of such an approach is that planetary cablers can only operate at speeds of about 70 RPM (rotations per minute), significantly slowing the yield. For example, use of a planetary cabler operating at about 70 RPM with Category 5 pair lays of less than 1 inch, yields less than 6 feet per minute. Moreover, use of a back twist machine equipped with a back twist neutralizer induces hardening into the copper wire. The long term effect of copper work-hardening is an undesired feature. Twisted pair cables already exhibit a spring back effect due to the coiling and twisting of copper wires as the cable is produced. The use of a back twist neutralizer further work-hardens the copper and increases the overall spring back seen by installers of the finished cable.

Increase in network speed has also driven networking designers to switch from employing two pairs of a cable in half duplex (one pair in each direction) to using all four pairs operating in full duplex (all pairs in both directions). This has added an additional need to further control and specify input impedance to minimize signal reflections (return loss).

The second parameter of importance in evaluating data cable performance is attenuation. Attenuation represents signal loss or dissipation as an electrical signal propagates down the length of a wire. Attenuation is dependent on the dielectric constant and dissipation factor (loss tangent) of the insulating material surrounding a conductor, characteristic impedance of the wire and the diameter of the copper conductor.

According to the EIA/TIA 568-A standard, conductor size has to be in the range of 22 AWG (American wire gage)–24 AWG to work with standard based connecting hardware, while maintaining individual insulated conductor outside diameter of 0.048" or less and an overall cable outside diameter no greater than 0.250".

Dielectric constant and dissipation factor of the insulating material surrounding the conductor is dependent upon materials selected for the application. In case of twisted pair conductors, it is important to consider the effective dielectric constant. This is especially true at elevated frequencies (50 MHZ and higher) where the electromagnetic fields travel through a greater surrounding area as skin depths in the conducting material decrease with increasing frequency.

Attenuation is also influenced by input impedance. Input impedance fluctuations about the characteristic impedance value represent signal reflections (return loss). The percentage of reflected energy versus transmitted energy increases as frequency increases. It is due to this increase in reflected energy that it is possible to see spikes in attenuation loss curves, especially at frequencies in excess of 100 MHz. These spikes represent signal loss due to reflections. Reflections occur due to variations in the structure of a twisted pair that cause input impedance to deviate from its targeted characteristic value.

Dissipation factor or loss tangent is normally viewed as an insignificant contributor to signal loss until it exceeds 0.1. It is at this point (transition from a low loss dielectric to a lossy dielectric) when conductance becomes a significant factor in evaluating signal loss. The effect must be evaluated on a material by material basis to assure a stable low loss tangent throughout the frequency range and the temperature range the cable will be operated at. These values for determining the impact of the loss tangent are only guidelines and require interpretation, especially with UTP products operating above 100 MHz over lengths of 100 meters (attenuation is greater than 20 dB). The added loss due to dissipation factor properties of dielectric materials may become significant in calculating the total loss, even though the loss tangent may still be slightly less than 0.1.

The third parameter of importance in evaluating data cable performance is crosstalk. Crosstalk represents signal energy loss or dissipation due to coupling between pairs. The interaction between attenuation and crosstalk, i.e., attenuation-to-crosstalk ratio (ACR), provides a measure of cable performance. The greater the ACR, the more headroom or data capacity a cable has. While, near-end crosstalk (NEXT) is a measure of signal coupling between pairs when measured at the input end of the cable, far-end crosstalk is a measure of signal coupling between pairs when measured at the output end of the cable.

Theoretically, crosstalk is proportional to the square of the distance between conductor centers of the energized pair and inversely proportional to the square of the distance between the center point of the energized pair and the receiving pair. Crosstalk coupling between pairs is also inversely proportional to the dielectric constant of the material separating the two pairs. Dissipation factor can also influence the amount of energy coupled between pairs, provided there is significant pair-to-pair separation and a relatively lossy material (loss tangent>0.1) is employed. However, a lossy material generally results in degraded attenuation performance, so the materials position with respect to the conducting pair must be considered.

EIA/TIA standards, however, only provide specifications for the above mentioned parameters, i.e., impedance, attenuation and crosstalk, in relation to transmission frequency up to 100 MHz. In particular, EIA/TIA 568-A for Category 5 cables regulates the performance of data cable up to a transmission frequency of 100 MHz. In addition to impedance, attenuation, and crosstalk, the EIA/TIA 568-A standard specifies dimensional constraints that must be adhered to by cable manufacturers when manufacturing high frequency data cables. For example, the EIA/TIA 568-A standard specifies that the conductor size fall within 22–24 AWG, the maximum insulated outside diameter be 0.048" and the maximum cable outside diameter (including jacket) be 0.250".

Realizing the need to provide data cable capable of achieving higher transmission frequencies, several manufacturers are attempting to produce cable that purportedly can achieve transmission frequencies in excess of 100 MHz. However, such data cables do not follow any guidelines beyond those set forth by the EIA/TIA 568-A Category 5 standard for transmission frequencies up to 100 MHz.

Any high performance data cable that performs at transmission frequencies in excess of 100 MHz, must meet or exceed the minimum impedance, attenuation and crosstalk parameters set forth for transmission frequencies up to 100 MHz by the EIA/TIA standard. Aside from electrical requirements, the EIA/TIA standard also sets forth physical requirements for the cable, e.g., conductor size, maximum insulated outside diameter, and the maximum cable outside diameter. However, as mentioned before, the EIA/TIA standard does not address requirements beyond the transmission frequency of 100 MHz.

It is therefore an object of the present invention to provide a high performance data cable that accommodates future growth in network speeds while meeting or exceeding the minimum impedance, attenuation and crosstalk parameters set forth for transmission frequencies unto 100 MHz by the EIA/TIA 568-A standard.

It is another object of the present invention to provide a high performance data cable that accommodates future growth in network speeds while satisfying the dimensional requirements set forth in the EIA/TIA 568-A standard.

It is yet another object of the present invention to provide a standard for a high performance data cable having a highest test frequency of 400 MHz.

It is a further object of the present invention to provide a high performance data cable that accommodates future growths in network speeds by controlling impedance, attenuation and near-end crosstalk.

SUMMARY OF THE INVENTION

These and other objects of the present invention are accomplished by providing high performance data cables that allow for future growth in networking speeds. Such high performance data cables are capable of high transmission frequencies while satisfying the dimensional and electrical performance requirements set forth by the EIA/TIA 568-A standard for transmission frequencies up to 100 MHz, as well as fire performance safety requirements of the National Fire Protection Association (NFPA).

High performance data cables according to this invention attain the above-mentioned requirements by controlling parameters that influence impedance performance, near-end crosstalk performance and attenuation. A separating filler material is used to maximize the pair-to-pair distance while maintaining an overall maximum outside diameter of 0.250". The separating filler material benefits crosstalk performance as both electrical and magnetic field intensities are inversely related to distance and dielectric constant (crosstalk is made up of capacitative and inductive coupling, with inductive coupling becoming significant at frequencies above 50 MHz). This construction also improves attenuation and impedance by improving the overall effective dielectric constant seen by these materials.

The filler has a cross sectional profile that maximizes the air space around the twisted conductor pairs while holding the pairs in a relatively fixed position within the core with relation to each other. This construction enhances attenuation performance by maximizing the air-dielectric about the pair and providing stable impedance performance. The filler also acts as a physical separator preventing pair-nesting allowing increase in conventional tight pair lays (<1.0") used in data cables to prevent nesting of pairs. As these lay lengths are increased, care must be taken to ensure that distortion and deformation does not occur from handling and tensioning of the wire in further processing. Additionally, the material of the filler is chosen such that the electromagnetic fields propagating down the wire are attenuated the lightest degree possible, and at the same time pair to pair coupling fields are attenuated the highest degree possible.

Furthermore, the jacket material is selected so that the cable is fully compliant with the National Fire Protection Association requirements while maintaining compliance with electrical specifications established for the high performance data cable of this invention. The attenuation performance of the product can be further optimized by employing low smoke, zero-halogen, polyethylene based materials or low loss flouropolymer materials (e.g., ECTFE, FEP).

This invention also provides standards for acceptable cable performance at a highest test frequency of 400 MHz. The standard takes into account attenuation to crosstalk ratio (ACR) as well as attenuation for 24 AWG copper wire used in twisted pair conductors.

Further features of the invention, its nature and various advantages will be more apparent from the accompanying drawings and the following detailed description of the illustrative embodiments.

DETAILED DESCRIPTION OF THE INVENTION

Figure 1:
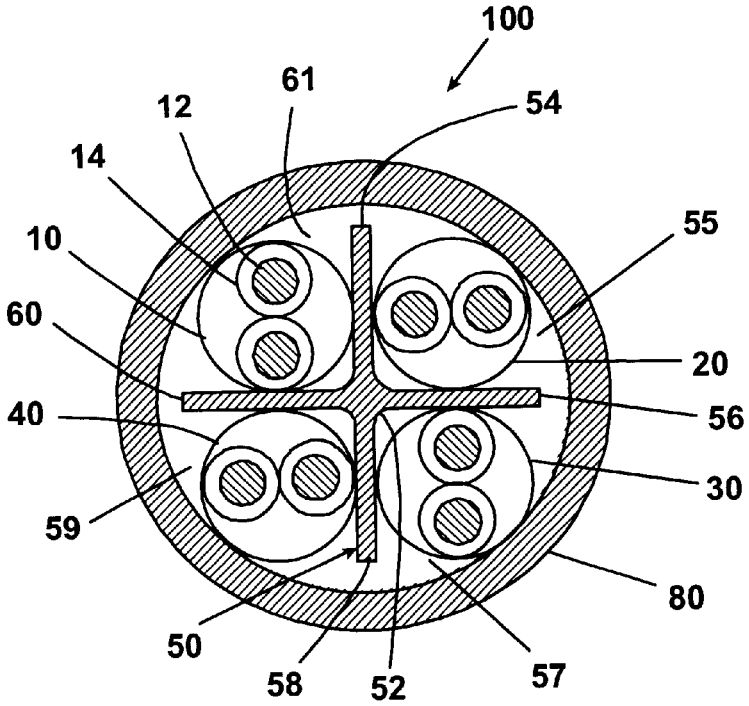
FIG. 1 is a sectional view of an illustrative embodiment of a high performance data cable in accordance with the present invention.

An illustrative embodiment of a high performance data cable 100 for providing high transmission frequencies, while meeting or exceeding the standards set forth by EIA/TIA 568-A and NFPA standards in accordance with the present invention, is shown in FIG. 1. High performance data cable 100 comprises four twisted pairs of conductors, 10, 20, 30 and 40, respectively. Each conductor of a twisted pair, in turn, comprises a metal, e.g., copper, core 12 enclosed within insulation 14. In the illustrative embodiment shown in FIG. 1, copper core 12 has a diameter of about 0.0220" and insulation 14 has a thickness of about 0.0085". Each twisted pair is separated from the other pairs by star separator 50.

Star separator 50 (shown in more detail in FIG. 2) comprises core 52, along the perimeter of which are longitudinal projections 54, 56, 58 and 60 that extend outward from core 52. Region 55, housing conductor 20, is located between projections 54 and 56. Similarly, region 57—housing conductor 30, region 59—housing conductor 40 and region 61—housing conductor 10, are located between adjacently located longitudinal projections.

By separating the four pairs of conductors from each other using star separator 50, pair-to-pair distance is maximized while maintaining the maximum outside diameter allowed by the EIA/TIA standard, i.e., 0.250". One of the benefits of increasing the pair-to-pair separation between the pairs of conductors is improvement in crosstalk performance. As described earlier, improvement in crosstalk performance is realized due to both electrical and magnetic field intensities being inversely related to pair-to-pair distance.

In addition, the cross sectional profile of star separator 50 allows for the air space around the conductors to be maximized. The afore-mentioned is, however, accomplished while holding each respective pair in a relatively fixed position within the core with relation to other pairs in the cable. Star separator 50 is made flexible to help the relative fixed positioning of the respective pairs and to also improve cable handling. This spatial orientation enhances attenuation performance by maximizing air-dielectric about the pairs and providing stable impedance performance.

Furthermore, since star separator 50 physically separates all the pairs of high performance cable 100, the threat of nesting amongst the pairs is eliminated. This, in turn, translates into more freedom in conventional tight pair lays. Thus, an increased tight pair lay (e.g., <1.0) may be used in high performance data cable 100.

Increased lay lengths translate to increased characteristic impedance performance. This is so because the characteristic impedance performance is inversely proportional to the number of twists per foot. However, as the lay lengths increase, care must be taken to ensure that distortion and deformation does not occur from handling and tensioning of the wire in further processing.

In addition to star separator 50 improving the crosstalk performance of high performance data cable 100, star separator 50 also improves the characteristic impedance of the cable. The improvement in characteristic impedance of high performance data cable 100 also favorably affects attenuation characteristics of the cable. However, separation of the respective pairs of conductors, in itself, does not result in the high transmission frequency performance characteristics of the cable of this invention.

While separation of the respective twisted pairs of conductors by star separator 50 enhances attenuation performance by maximizing the air dielectric about the pairs, care must also be taken in selecting the material of star separator 50 as well as insulation material 14 surrounding the conductors. Insulation material 14 may be made of materials having characteristics similar to, for example, fluorinated perfluoroethylene polypropylene (FEP) and high density polyethylene (HDPE). While, on one hand, the attenuation performance is enhanced by maximizing the air-dielectric about the pairs, consequently providing stable impedance performance, the material of star separator 50 must be chosen to minimize or avoid any increase in loss due to attenuation and, in turn, high signal loss.

As described previously, attenuation represents the amount of signal that is lost or dissipated as an electrical signal propagates down a length of wire. In light of the above, the material for star separator 50 is chosen such that the electromagnetic fields propagating down the conductor are attenuated to the lightest degree possible, while at the same time pair-to-pair coupling fields are attenuated to the highest degree possible.

As described before, the use of star separator 50 to compartmentalize pairs and isolate them from each other is particularly beneficial for crosstalk performance. However, choice of the proper material is critical in the total design of high performance data cable 100. Choice of incorrect material would mean failure on one or more of the parameters described before. Thus, a balance between electrical, electromagnetic and physical properties must be reached to optimize the performance of data cable 100.

Figure 2:
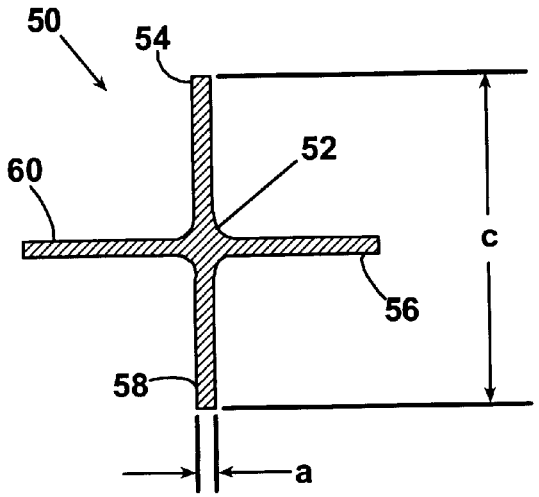
FIG. 2 is a sectional view of the filler material shown in FIG. 1 used to separate the pairs of conductors from each other in accordance with the present invention.

In the illustrative embodiment shown in FIG. 2 (not to scale), star separator 50 comprises flame retardant polyethylene FRPE having a dielectric constant of 2.5 and a loss factor of 0.001. It is not desirable for star separator 50 to have a dielectric constant greater than 3.5 in the frequency range from 1 MHz to 400 MHz. Longitudinal projections 54, 56, 58 and 60 that separate the conductor pairs of high performance data cable 100 from each other have a wall thickness "a" of 0.0125". The outside diameter "c" of star separator 50 is 0.175". It should be understood that star separator 50 may also be made of other materials having characteristics similar to those described above, such as, for example, polyfluoroalkoxy (PFA), TFE/Perfluoromethylvinylether (MFA), ethylene chlorotrifluoroethylene (ECTFE), polyvinyl chloride (PVC), fluorinated perfluoroethylene polypropylene (FEP) and flame retardant polypropylene (FRPP).

Figure 3:
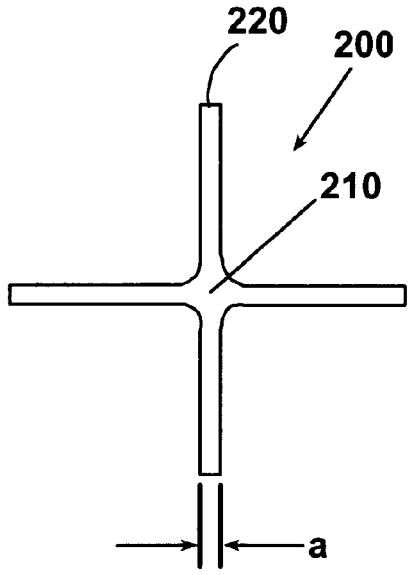
FIG. 3 is a sectional view of another embodiment of the filler material shown in FIG. 1 used to separate the pairs of conductors from each other in accordance with the present invention.

In the illustrative embodiment shown in FIG. 3 (not to scale), star separator 200 allows grounding of an internal cable shield. Star separator 200 comprises ferrous conductive metallic shield 210 covered by outside material 220 having a low dielectric constant and low loss. Outside material 220, having a low dielectric constant, prevents increase in attenuation, while inner ferrous conductive metallic shield 210 reduces crosstalk without significantly affecting attenuation. Inner ferrous conductive metallic shield 210 does not significantly affect attenuation in the conductor because attenuation affects are known to reduce with distance. The wall thickness of star separator 200 is calculated by using the formula:

$$\text{Wall Thickness(a)}=\text{insulation wall thickness}+1.5*\text{conductor outside diameter} \quad (1)$$

In yet another embodiment, one not allowing for a cable shielding ground, the star separator comprises two dielectric materials. The outer material has a low dielectric constant (<3.5), low loss (<0.1) and has a wall thickness that is calculated using formula 1. The center material has a high dielectric (>3.5), is lossy (>0.1) and has a thickness sufficient to achieve the desired near-end crosstalk performance while maintaining an overall cable outside diameter of less than 0.250".

Figure 4:
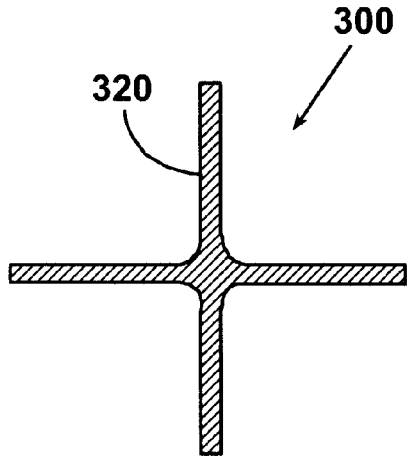
FIG. 4 is a sectional view of another embodiment of the filler material shown in FIG. 1 used to separate the pairs of conductors from each other in accordance with the present invention.

In the illustrative embodiment shown in FIG. 4 (not to scale), star separator 300 is made of graded dielectric/conductive material 320 going from a low dielectric constant with a low dissipation factor on the outer most surface to a high conductive material on the inner most layer. The above can be achieved by, for example, doping the material such that it attains the desired electrical characteristics.

For high performance data cable 100 to meet the requirements of EIA/TIA standard and be fully compliant with NFPA requirements, the material comprising jacket 80 (FIG. 1) of high performance cable 100 must, too, be chosen carefully. Factors that are considered in selecting the proper material to make jacket 80 include flame and smoke ratings for plenum and risers as required by NFPA, insulating ability in light of the high transmission frequencies and high data rates the cable would be subjected to, flexibility and durability, and performance capabilities in temperature extremes ranging from 140° F. to sub-zero.

A low loss (loss tangent<0.1) material having a dielectric constant less than 3.5 for jacket 80 meets the electrical specifications of high performance cable 100. The attenuation performance of high performance data cable 100 is further optimized by employing materials for the jacket that meet or exceed the required electrical properties while meeting the flame and smoke ratings. Some of the materials found suitable are polyvinyl chloride (PVC), ethylene chlorotrifluroethylene (ECTFE) and fluorinated perfluorethylene polypropylene (FEP).

In another embodiment, the total thickness of star separator is reduced by using a star separator comprising of a single dielectric material having a compromised dielectric constant and dissipation constant factor. The wall thickness of the star separator in this embodiment is calculated using formula:

$$\text{Wall Thickness(a)}=1.5*\text{conductor outside diameter} \quad (2)$$

In still another embodiment, one especially suitable for systems utilizing multi-pair transmission and, therefore, suffering from multi-disturber (commonly characterized as power-sum) near-end crosstalk concerns, the minimum wall thickness is determined using formula:

$$\text{Filler Wall Thickness(a)}=2*(\text{insulation wall thickness}+1.5*\text{conductor outside diameter}) \quad (3)$$

A standard for high performance data cables tested for transmission frequencies as high as 400 MHz is also disclosed. The standard, in particular, focuses on attenuation (ATTN), crosstalk and skew characteristics at various electrical bandwidths and cable lengths using ACR worst pair NEXT testing as well as ACR power-sum NEXT testing. The requisite specifications for distances of 90 meters and 100 meters are tabulated below under respective headings.

TABLE 1

| | | ACR Worst Pair NEXT (90 meter lengths) ELECTRICAL BANDWIDTH | | | |
|---|---|---|---|---|---|
| 100 OHM UTP PERFORMANCE LEVEL | HIGHEST TEST FREQ. MHz | MHz as ACR ≧ 10 dB FREQUENCY 24 AWG | MHz as ATTN ≦ 33 dB FREQUENCY 24 AWG | MHz as ACR > 0 dB FREQUENCY 24 AWG | OTHER REQUIRED MEASUREMENTS |
| 7 | 400 | 200 | 230 | 300 | ISO IMP-SRL <25 NS SKEW LCL MIN |

TABLE 2

| 100 OHM UTP PERFORMANCE LEVEL | HIGHEST TEST FREQ. MHz | MHz as ACR ≧ 10 dB FREQUENCY 24 AWG | MHz as ATTN ≧ 33 dB FREQUENCY 24 AWG | MHz as ACR > 0 dB FREQUENCY 24 AWG | OTHER REQUIRED MEASUREMENTS |
|---|---|---|---|---|---|
| | | ACR Powersum NEXT (100 meter lengths) | | | |
| 7 | 400 | 160 | 230 | 250 | ISO IMP-SRL <25 NS SKEW LCL MIN |

The high performance data cable of this invention has a minimum high test frequency of 400 MHz and for lengths of 90 meters is characterized by an ACR of at least 10 dB at a frequency of 200 MHz and an ACR of at least 0 dB at a frequency of 300 MHz measured using worst-pair NEXT testing. The high performance data cable of this invention, for lengths of 100 meters, is characterized by an ACR of at least 10 dB at a frequency of 160 MHz and an ACR of at least 0 dB at a frequency of 250 MHz measured using powersum NEXT testing.

It will be understood that the foregoing is only illustrative of the principles of this invention and that various modifications can be made by those skilled in the art without departing from the scope and spirit of the invention.

What is claimed is:

1. A communication cable comprising:

a plurality of twisted pair conductors, each of said twisted pair conductors including a pair of individually insulated metal conductors that are twisted together to form one of said plurality of twisted pair conductors;

a separator having a plurality of outwardly protruding projections angularly spaced about a core, said plurality of outwardly protruding projections having substantially parallel sides and protruding radially from said core and defining regions between adjacent ones of said outwardly protruding projections within each of which one of said plurality of twisted pair conductors is contained, said regions and said projections sized to maximize air about each one of said twisted pair conductors; and a communication cable jacket enclosing said plurality of twisted pair conductors separated by said plurality of outwardly protruding projections of said separator; wherein:

said communication cable has a high test frequency of 400 MHz and for lengths of 90 meters is characterized by an ACR (attenuation to crosstalk ratio) of at least 10 dB at a frequency of 200 MHz and an ACR of at least 0 dB at a frequency of 300 MHz measured using worst-pair NEXT testing, and said communication cable for lengths of 100 meters is characterized by an ACR of at least 10 dB at a frequency of 160 MHz and an ACR of at least 0 dB at a frequency of 250 MHz measured using powersum NEXT testing.

2. The communication cable of claim 1 wherein said metal conductors comprise copper conductors having a diameter of about 0.0220 inches.

3. The communication cable of claim 1 wherein insulation for said metal conductors comprises fluorinated perfluoroethylene polypropylene (FEP).

4. The communication cable of claim 3 wherein said insulation has a thickness of about 0.0085 inches.

5. The communication cable of claim 1 wherein insulation for said metal conductors comprises high density polyethylene (HDPE).

6. The communication cable of claim 1 wherein said separator is flexible.

7. The communication cable of claim 1 wherein said separator has a dielectric constant of at most 3.5 in a frequency range from 1 MHz to 400 MHz.

8. The communication cable of claim 1 wherein said outwardly protruding projections of said separator have a width of about 0.0125 inches.

9. The communication cable of claim 1 wherein said separator has a diameter of about 0.175 inches.

10. The communication cable of claim 1 wherein said separator comprises polyvinyl chloride.

11. The communication cable of claim 1 wherein said separator comprises fluorinated perfluoroethylene polypropylene (FEP).

12. The communication cable of claim 1 wherein said separator comprises ethylene chlorotrifluoroethylene (ECTFE).

13. The communication cable of claim 1 wherein said separator comprises polyfluoroalkoxy (PFA).

14. The communication cable of claim 1 wherein said separator comprises TFE/Perfluoromethylvinylether (MFA).

15. The communication cable of claim 1 wherein said separator comprises flame retardant polypropylene (FRPP).

16. The communication cable of claim 1 wherein said separator is plenum rated.

17. The communication cable of claim 1 wherein said separator is riser rated.

18. The communication cable of claim 1 wherein said cable jacket is plenum rated.

19. The communication cable of claim 1 wherein said cable jacket is riser rated.

20. The communication cable of claim 1 wherein said cable jacket can withstand temperatures between 140° F. and below 0°F.

21. The communication cable of claim 1 wherein said separator comprises an inner material and an outer material.

22. The communication cable of claim 21 wherein said outer material has a dielectric constant of at most 3.5 in a frequency range from 1 MHz to 400 MHz.

23. The communication cable of claim 21 wherein said inner material has a dielectric constant that is higher than that of said outer material.

24. The communication cable of claim 21 wherein said inner material has a higher dissipation factor than said outer material.

25. The communication cable of claim 1 wherein said separator comprises a graded material, wherein said graded material has lower dielectric constant, and dissipation factor on the outside than on the inside.

26. In a high performance data cable having a diameter less than 0.250 inches and including a plurality of insulated conductor pairs, an interior support for separating the conductor pairs and for controlling parameters that influence impedance performance, near-end crosstalk performance and attenuation, comprising:

a plurality of radially outwardly protruding projections angularly spaced about a core, said plurality having substantially parallel sides and defining regions between adjacent projections within each of which one of the plurality of insulated conductor pairs is contained, said regions and said projections sized to maximize air about each one of the insulated conductor pairs.

* * * * *